US005612298A

United States Patent [19]

Bae et al.

[11] Patent Number: 5,612,298

[45] Date of Patent: Mar. 18, 1997

[54] GREASE FOR CONSTANT VELOCITY JOINTS

[75] Inventors: Dae Y. Bae, Kyungsangnam-do; Sung G. Son, Dae-ku, both of Rep. of Korea

[73] Assignee: Hyundai Motor Company, Seoul, Rep. of Korea

[21] Appl. No.: 569,611

[22] Filed: Dec. 8, 1995

[30] Foreign Application Priority Data

Oct. 11, 1995 [KR] Rep. of Korea ..... 95-34810

[51] Int. Cl.[6] ..... C10M 141/02; C10M 141/06

[52] U.S. Cl. ..... 508/376; 508/379

[58] Field of Search ..... 252/32.7 E, 25, 252/33.6; 508/376, 379

[56] References Cited

U.S. PATENT DOCUMENTS

| | | | |
|---|---|---|---|
| 3,322,802 | 5/1967 | Brooks et al. . | |
| 3,400,140 | 9/1968 | Rowan et al. . | |
| 3,509,051 | 4/1970 | Farmer et al. . | |
| 3,840,463 | 10/1974 | Froeschmann et al. . | |
| 4,208,292 | 6/1980 | Bridger . | |
| 4,428,861 | 1/1984 | Bridger . | |
| 4,466,895 | 8/1984 | Schroeck . | |
| 4,466,901 | 8/1984 | Hunt et al. . | |
| 4,692,256 | 9/1987 | Umemura et al. . | |
| 4,846,983 | 7/1989 | Ward, Jr. | 252/33.6 |
| 5,160,645 | 11/1992 | Okaniwa et al. | 252/33.6 |
| 5,207,936 | 5/1993 | Anzai et al. | 252/33.6 |
| 5,246,604 | 9/1993 | Vartanian | 252/33.6 |
| 5,246,605 | 9/1993 | Vartanian | 252/33.6 |
| 5,449,471 | 9/1995 | Ozaki et al. | 252/51.5 A |
| 5,462,683 | 10/1995 | Kinoshita et al. | 252/33.6 |
| 5,487,837 | 1/1996 | Ozaki et al. | 252/33.6 |

*Primary Examiner*—Jacqueline V. Howard

*Attorney, Agent, or Firm*—Finnegan, Henderson, Farabow, Garrett & Dunner, L.L.P.

[57] ABSTRACT

This invention relates to a grease for constant velocity joints which comprises of organic molybdenum compound, antimondialkyl dithiocarbamate (referred as Sb-DTC), zinc dithiophosphate and organic sulfide with conventionally used lithium grease or lithium aluminum grease and particularly as an organic molybdenum compound is used molybdenum dialkyldithio carbamate having good thermal stability, low friction coefficient and good extreme pressure.

5 Claims, No Drawings

GREASE FOR CONSTANT VELOCITY JOINTS

BACKGROUND OF THE INVENTION

This invention relates to a grease for constant velocity joints, in particular, a grease for constant velocity joints which has a good extreme pressure property, good durability and vibration inhibiting effect by adding organic molybdenum compound, antimonydialkyl dithiocarbamate (hereinunder referred as Sb-DTC), a zinc dithio phosphate and organic sulfur compound.

The conventionally used greases include greases containing sulfur-phosphorus extreme pressure agent and an extreme pressure grease containing molybdenum disulfide and these greases are in general used in lubricating parts where wears and fretting corrosions are easily caused by extreme pressure, such as constant velocity joints used in motorcars (C.V.J), universal joint, steer linkage, spline shaft gear, coupling in industrial machine, gear motor and transmission gear.

Greases for wear-inhibiting and extreme pressure composed of sulfur-phosphorus compound were disclosed in U.S. Pat. Nos. 4,466,895 and 3,322,802 and Japanese Patent Publication Soh 66-47099. In these greases, by using sulfur-phosphorus compound independently or in complex, the friction coefficient and extreme pressure were improved. But in order to increase the extreme pressure and decrease the friction coefficient high temperature, a comparatively large amount of additives are required to be used. Some problems remained unsolved such as thermal decomposition of grease by active sulfide derived from the decomposition of sulfur-phosphorus compound in causing high temperature, corrosion and aging by acidic compound.

Greases using organic molybdenum, were disclosed in U.S. Pat. Nos. 3,840,463, 4,466,901, 4,428,861, 3,400,140 and 4,208,292 which describes greases using organic molybdenum compound (Mo-DTP) independently of other extreme pressure additives. Further U.S. Pat. No. 3,509,051 disclosed a grease which is characterized in using polyurea thickener, organic molybdenum compound, especially molybdenum dialkyl dithiocarbamate (Mo-DTC) and organic zinc compound in mixed condition to the basic oil. However, with respect to the use of organic molybdenum independently, wear-resistance is increased owing to a decrease in the friction coefficient, and there is no synergistic effect between the organic molybdenum and other extreme pressure additives. And as there are limits in extreme pressure of molybdenum disulfide ($MoS_2$) compound produced by the decomposition of organic molybdenum, in friction condition where extreme pressure property is greatly required, great heat radiation due to lubrication in friction area and great deal of wears like scoring caused.

And in case that a mixture of an organic molybdenum compound and an organic zinc compound (Zn-DTP) is used as with a lithium grease there is an increase in both, friction coefficient and wear-resistance. Though the critical temperature of lithium grease is 120° C., particularly in flanging type constant velocity joints wherein the rolling friction and sliding friction simultaneously occur, the temperature the of surrounding area increases to over the maximum 120° C. because the of impulse load and frictional heat caused by sliding friction. Furthermore, the thermal decomposition temperature of Mo-DTP and Zn-DTP is low therefore are readily decomposed at 120° C. into molybdenum disulfide compound and some cause some detrimental side-effects such as corrosion, sludge and slight-corrosions remain unsolved.

Further Japanese Patent Publication Pyung 5-62639 disclosed a grease composition comprised of molybdenum a compound and sulfur compound, which improved oxidation stability, wear resistance and corrosion-inhibiting effects but failed to reduce the beating noise and vibrations.

Conventionally used greases do not infiltrate into the lubricating area well in bad lubrication conditions which can result in wear and wear vibrations. And in the parts where slight vibrations do occur, the oxide produced by initial corrosion accelerates the wear, and abnormal beating noise, and vibrations occur.

Therefore, the inventors have made efforts to solve the aforementioned problems and at last have succeeded invent a grease which is characterized in that the extreme pressure and the wear-resistance properties are greatly improved, using organic molybdenum, antimony dialkyl dithiocarbamate, zinc dithiophosphate and organic sulfide compound in mixed condition; sludge occurrence possibility is reduced by improving thermal stability of additives; infiltration into the lubricating area is made easy by low viscosity; and good durability is aquired when it applied to constant velocity joints.

SUMMARY OF THE INVENTION

The object of this invention is to provide a grease for constant velocity joints having improved wear-resistance property, durability, extreme pressure property and vibration inhibiting effect.

This invention is characterized in adding 0.5–5 wt % of an organic molybdenum compound, 0.5–5 wt % of antimonydialkyl dithiocarbamate (Sb-DTC), 0.5–5 wt % of zincdithiophosphate and 0.5–10 wt % of an organic sulfide to the conventionally used lithium grease or lithium aluminum mixed grease.

DETAILED DESCRIPTION OF THIS INVENTION

This invention relates to a grease for constant velocity joints which comprises an organic molybdenum compound, an antimonydialkyl dithiocarbamate, a zinc dithiophosphate and an organic sulfide with a conventionally used lithium grease or lithium aluminum grease. Preferably, the organic molybdenum compound is molybdenum dialkyldithio carbamate having good thermal stability, low friction coeffieicnt and good extreme pressure.

Preferably, as the above mentioned molybdenum dialkyldithio carbamate, 0.5–5 wt % of molybdenum oxysulfide dialkyldithio carbamate is used represented by formula (I):

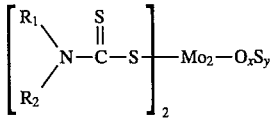

(I)

wherein, $R_1$ and $R_2$ represent a $C_1$–$C_{24}$ alkyl group respectively, x+y=4, and x=0–3, y=1–4

If the content of organic molybdenum is less than 0.5 wt %, wear-resistance property, extreme pressure property and oxidation stability is decreased and in high temperature, the decrease of friction coefficient, as well as cooling effect, is weakened because of enduthermic decomposition of Mo-DTC. If the content of molybdenum is more than 5 wt %, corrosive compounds such as disulfide molybdenum ($MoS_2$), hydrogen sulfide ($H_2S$), carbon disulfide ($CS_2$) and mercaptan (RSH) are produced and the wear inhibiting effect is decreased.

The above mentioned antimonydialkyl dithiocarbamate (Sb-DTC) is preferably by used in amount of 0.5–5 wt %, and is more preferably represented by formula (II):

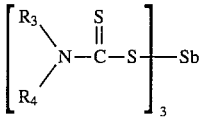

(II)

wherein, $R_3$ and $R_4$ represent a $C_1$–$C_{24}$ alkyl and aryl group, respectively.

If the content of the Sb-DTC is less than 0.5 wt %, extreme pressure and oxidation stability is declined and if it is more than 5 wt %, some corrosive compounds such as hydrogen sulfide($H_2S$), carbon disulfide($CS_2$) and mercaptan (RSH) can be produced during its thermal decomposition.

Preferably, the zinc dithiophosphate is used in an amount of 0.5~5wt %, and more preferably is represented by formula (III):

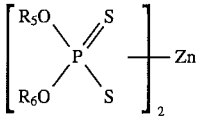

(III)

wherein, $R_5$ and $R_6$ represent an octyl group.

If the content of zinc dithio phosphate is less than 0.5 wt %, wear-resistance property is decreased at low temperature and if it is more than 5 wt %, thermal unstability at high temperature is caused.

Preferably, sulfide plant oil, sulfide mineral oil or sulfide amine oil such as didodecyl polysulfide or dinonyl polysulfide is used in the amount of 0.5–10 wt % as the sulfide compound. If it is used in a amount less than 0.5 wt %, load-resistance is low and if it exceeds 10 wt %, wear resistance and oxidation stability are lowered.

As a grease, a conventionally used grease such as lithium grease, calcium grease, aluminum grease, mixed grease thereof, lithium complex grease, soap grease like a aluminum complex, inorganic grease like a bentonite grease, synthetic grease such as urea grease, threphthalamid grease, can be used.

And mineral oil, synthetic oil or a mixture thereof can be used as a base oil.

However, for constant velocity joints, which require great thermal resistance effect, lithium grease, lithium aluminum mixed grease and urea grease is desirable. But if urea grease is used, wear resistance effect is good but extreme pressure is lowered.

If organic molybdenum, Sb-DTC, zinc dithiophosphate, organic sulfur compounds are used in addition to lithium aluminum mixed grease, this invention shows low friction coefficient and high extreme pressure and wear resistance effect at high temperatures over 100° C.

As described above, the grease of this invention shows significant reduction of friction coeffieicnt and extreme pressure compared with the combined use of conventional organic molybdenum or organic sulfurphosphorus compound and also shows effects as thermal resistance and beating noise-proof. Therefore, the present invention is particularly useful for use in constant velocity joints of motocars.

WORKING EXAMPLE 1

This is a method for preparing lithium grease. Base oil (86 Kg), which has viscosity of 200 cSt at 40° C. and viscosity of 16 cSt at 100° C., was put into the reactor. After 12-hydroxystearineacid (24 Kg) was added, the mixture was stirred and dissolved at 85°~90° C. By adding lithium hydroxide (3.36 kg) diluted with water 17 kg at 70° C. in small amount, it was soapinicated for about one hour. When it becomes 130° C., the neutralization number was measured. And the measured value was suitable condition of 0.4~1.0 mg KOH/g alkali, the mixture was heated to 200° C. with stirring. At this time, most moisture produced during the reaction was evaporated. Base oil (75.64 kg) was added to resulted lithium 12-hydroxystearate and the mixture was crystalized into gel type. Then stirring in a cooling apparatus, it was slowly cooled to 60° C., and lithium grease of 189 kg was obtained.

WORKING EXAMPLE 2

This is a method for preparing urea grease. The base oil (85.6 Kg), which is that of Working Example 1, and anyline (8.6 kg) were mixed and stirred for about 10 minutes at room temperature. Then adding toluene diisocyanate (TDI) of 8.2 kg little by little by spraying for 30~40 minutes, the mixture was stirred. When the addition is finished, the temperature is lowered to 60° C. After finishing the addition, the mixture was reacted for about 15 minutes with stirring without heating and then it was heated to 160° C. and stirred for 45 minutes at same temperature. Then cooling with a cooling apparatus, urea grease of 102 kg was obtained.

WORKING EXAMPLE 3

This is a method for preparing lithium aluminum mixed grease. In the processes of above Working Example 1, aluminumstearate 2 kg was reacted with stirring at 160° C., where evaporations are hardly occurred. And with the same method of Working Example 1, lithium aluminum mixed grease of 191 kg was obtained.

Example 1~3, Comparative Example 1~5

Adding additives to the conventional grease at 60° C. with stirring, which was obtained according to Working Example 1~3 with the contents of the following Table 1, it was cooled to 50° C. When it became 50° C., it was homogenized with Gauline under the pressure of 400 bar, was deaired in vacum condition and was filtrated with 100μ filter. Through these process, grease was obtained.

TABLE 1

(unit: wt %)

| | | Working Example | | | Comparative Example | | | | |
|---|---|---|---|---|---|---|---|---|---|
| | | 1 | 2 | 3 | 1 | 2 | 3 | 4 | 5 |
| Conventional Grease | lithium grease | 94 | | 94 | 83 | | 90 | 94 | 94 |
| | urea grease | | | | | 94 | | | |
| | lithium aluminum mixed grease | | 94 | | | | | | |

TABLE 1-continued

| | | Working Example | | | Comparative Example | | | | |
|---|---|---|---|---|---|---|---|---|---|
| | | 1 | 2 | 3 | 1 | 2 | 3 | 4 | 5 |
| Additives | molybdenumdialkyldithiocarbamate | 2.0 | 1.5 | 1.5 | 1.5 | | 3.0 | | 2.0 |
| | molybdenumdialkyldithiophosphate | | | | | 2.0 | | 2.0 | |
| | antimondialkyldithiocarbamate | 1.0 | 1.0 | 1.5 | 3.0 | | | | |
| | zincdithiophosphate | 2.0 | 1.5 | 1.0 | 1.5 | 4.0 | 3.0 | 1.5 | 4.0 |
| | organic sulfide compound | 1.0 | 2.0 | 2.0 | 8.0 | | | | |
| | organic lead compound | | | | 3.0 | | 4.0 | 2.5 | |

(unit: wt %)

Note:
(1) MOLYVAN A, available from Vanderbilt company
(2) MOLYVAN L, available from Vanderbilt company
(3) Vanlube 73, available from Vanderbilt company
(4) RC 3180, available from Rhein chemie company
(5) RC 2515, available from Rhein chemie company
(6) Vanlube 71, available from Vanderbilt company Experimental Example Physical properties of these greases were evaluated under the following condition. The results thus obtained are also listed in the following Table 2 and 3. The measured physical properties are wear preventive characteristics (4-ball method), TIMKEN load-resistance, slight corrosion state, vibration level, 4-ball extreme pressure properties (4-ball method), penetration, dropping point and friction coefficient.

Wear preventive characteristics (4-ball method) was measured for 60 minutes at a load of 40 kgf in 1200 rpm at 100° C. and TIMKEN load resistance was measured for 10 minutes in 800 rpm at 25° C. with the method defined in ASTM D 2509.

And the slight corrosion state was measured after three hours operation under the frequency of 50 Hz, amplitude of 0.5 mm, surface pressure of 1.5 N/mm$^2$ at 25° C.

The vibration level was measured with vibration censor attached vertically to DOJ which locates near at the lower part of transmission of motor car driven at 3-step acceleration in sound-proofed room. In Table 3, T1,T2,T3 and T6 are vertical vibration and each element of tire revolution.

Penetration was measured by the method defined ASTM D 217 and dropping point was measured by the method defined ASTM D 566.

4-ball extreme pressure properties was measured with a method defined ASTM D 2596 and friction coefficient was measured ASTM D 5183.

TABLE 2

| | | Working Example | | | Comparative Example | | | | |
|---|---|---|---|---|---|---|---|---|---|
| | | 1 | 2 | 3 | 1 | 2 | 3 | 4 | 5 |
| Tested property | Penetration (60 w) | 282 | 280 | 275 | 268 | 280 | 278 | 276 | 280 |
| | dropping point (°C.) | 192 | 191 | 190 | 192 | 264 | 192 | 191 | 190 |
| | 4-ball-wear (mm) | 0.40 | 0.41 | 0.42 | 0.69 | 0.54 | 0.72 | 0.59 | 0.46 |
| | 4-ball-EP (KGF) | 400 | 400 | 400 | 350 | 160 | 250 | 250 | 200 |
| | TIMKEN (KGF) | 33.6 | 36.3 | 36.3 | 27.2 | 20.4 | 18.1 | 24.5 | 18.1 |
| | friction coefficient | 0.034 | 0.047 | 0.055 | | | | | |
| | slight corrosion state | ⊙ | ⊙ | ⊙ | X | ⊙ | Δ | Δ | ○ |

Note;
⊙: No corrosion
○: small amount of corrosion
Δ: much corrosion
X: great deal of corrosion

TABLE 3

| | rpm | | | | | | | | | | | |
|---|---|---|---|---|---|---|---|---|---|---|---|---|
| | 2000~3000 | | | | 3000~4000 | | | | 4000~5000 | | | |
| grease | T1 | T2 | T3 | T6 | T1 | T2 | T3 | T6 | T1 | T2 | T3 | T6 |
| Example 1 | 0 | 0 | 0 | −5 | 0 | 0 | +5 | −5 | −5 | −5 | −5 | −10 |
| Example 2 | 0 | −5 | −5 | −5 | −5 | 0 | −5 | −5 | −5 | 0 | −5 | −10 |

TABLE 3-continued

| | rpm | | | | | | | | | | | |
|---|---|---|---|---|---|---|---|---|---|---|---|---|
| | 2000~3000 | | | | 3000~4000 | | | | 4000~5000 | | | |
| grease | T1 | T2 | T3 | T6 | T1 | T2 | T3 | T6 | T1 | T2 | T3 | T6 |
| Example 3 | −5 | 0 | +5 | −5 | 0 | 0 | −5 | +5 | 0 | 0 | −10 | −10 |
| Example 4 | 0 | 0 | 0 | 0 | 0 | 0 | 0 | 0 | 0 | 0 | 0 | 0 |

Note;
0: vibration state of Example 4
−10: 10 dB superior to those of Example 4
−5: 5 dB superior to those of Example 4
+5: 5 dB inferior to those of Example 4

As shown in the above results, when the organic molybdenum and extreme pressure agents are used together, the TIMKEN extreme pressure, the critical point of wear-resistance and scoring, is excellent and especially when Mo-DTC among the organic molybdenum and sulfur compound was used, its wear-resistance and extreme pressure becomes the highest.

And lithium alumimum mixed grease shows almost same properties with lithium grease and urea grease has better wear-resistance property but worse extreme pressure than lithium grease. And in vibration level test, the experimental material used in Example 1~3, compared with those of Example 4, have similar sound in low speed 2000~3000 rpm but in high speed of 4000~5000 rpm, T6 show improved sound.

What is claimed is:

1. A grease for constant velocity joints, comprising:

0.5–5 wt % of an organic molybdenum compound;

0.5–5 wt % of an antimonydialkyl dithiocarbamate;

0.5–5 wt % of a zincdithiophosphate;

0.5–10 wt % of an organic sulfide; and up to about 98 wt % of a lithium grease or a lithium aluminum mixed grease.

2. The grease for constant velocity joints as claimed in claim 1, wherein said organic molybdenum compound is molybdenumoxysulfide dialkyl dithiocarbamate represented by formula (I):

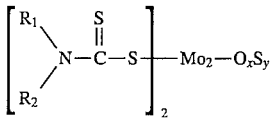

(I)

wherein, $R_1$ and $R_2$ represent a $C_1$–$C_{24}$ alkyl group, respectively, x+y=4, x=0–3, and y=1–4.

3. The grease for constant velocity joints as claimed in claim 1, wherein said antimonydialkyl dithiocarbamate compound is represented by formula (II):

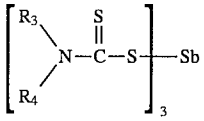

(II)

wherein, $R_3$ and $R_4$ represent a $C_1$–$C_{24}$ alkyl and aryl group, respectively.

4. The grease for constant velocity joints as claimed in claim 1, wherein said zincdithiophosphate is represented by formula (III):

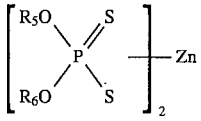

(III)

wherein, $R_5$ and $R_6$ represent an octyl group.

5. The grease for constant velocity joints as claimed in claim 1, wherein said organic sulphide is didodecyl polysulfide or dinonyl polysulfide.

* * * * *